United States Patent [19]

Gerson

[11] Patent Number: 4,703,298

[45] Date of Patent: Oct. 27, 1987

[54] THERMOSTAT WITH CERAMIC MOUNTING PINS OF RESISTIVE MATERIAL

[75] Inventor: Philips M. Gerson, Velp, Netherlands

[73] Assignee: Texas Instruments Incorporated, Dallas, Tex.

[21] Appl. No.: 927,193

[22] Filed: Nov. 4, 1986

[51] Int. Cl.[4] ..... H01H 61/02; H01H 37/04

[52] U.S. Cl. ..... 337/102; 337/103; 337/107

[58] Field of Search ..... 337/102, 103, 104, 105, 337/106, 107, 99, 100; 219/511

[56] References Cited

U.S. PATENT DOCUMENTS 3,525,914 8/1970 Vind ..... 337/107

4,528,540 7/1985 Stiekel et al. ..... 337/102

*Primary Examiner*—Harold Broome

*Attorney, Agent, or Firm*—James P. McAndrews; John A. Haug; Melvin Sharp

[57] ABSTRACT

A thermostat comprises a bimetal switch element reacting upon changes in temperatures which on one of its ends is fastened to a frame and on its other end is provided with an electric contact adapted to engage a fixed contact provided on the frame. The frame comprises two mutually parallel sheet-like metallic contact carriers forming a base unit, through which two parallel pins are extending for connection of both contact carriers and on which pins the contact carrierrs, with a tight fit, are slidable to and fro relative to one another while being held in permanent mutually parallel relation during the sliding. The parallel pins in the thermostat are formed of a ceramic material of positive temperature coefficient of resistivity which serve to electrically space the two metallic contact carriers while also serving as a self-regulating external heating means for the thermostat.

3 Claims, 2 Drawing Figures

THERMOSTAT WITH CERAMIC MOUNTING PINS OF RESISTIVE MATERIAL

BACKGROUND OF THE INVENTION

This invention relates to a thermostat adapted to open a circuit in response to temperature change and relates more particularly to a thermostat having heating means for keeping the circuit open until the thermostat is manually reset.

A known thermostat comprises a bimetal switch element reacting upon temperatures, which on one of its ends is fastened on a frame and on the other end is provided with an electric contact adapted to engage a fixed contact provided on the frame, said frame comprising two mutually parallel sheet-like metallic contact carriers forming a base unit, through which two parallel pins are extending for connection of both contact carriers and on which pins the contact carriers, with a tight fit, are slidable to and fro relative to one another to be held permanent mutually parallel during mounting, which thermostat may be provided with an external heating means and/or an internal heating means, and a selected heat capacity, as well as with various embodiments of connecting terminals for the contact carriers.

Such a thermostat has been described in U.S. Pat. No. 4,528,540.

A number of embodiments of the known thermostat are shown in the noted patent for influencing the current sensibility and/or the times of switching the thermostat on and off. The patent also shows various connection and mounting possibilities.

For instance various embodiments of connecting terminals for the contact carriers are shown: an external heating element that is fed by the current to be switched is shown, possibly being arranged in or on means of a selected heat capacity; and the contact carriers, one or both of which being made in a resistance material, are shown being possibly combined with a special configuration of said carriers and/or an additional means of selected heat capacity.

Furthermore the possibility is indicated in the patent of adding to these embodiments a heat source preferably with PTC characteristics, connected in parallel, for keeping the thermostat open after being opened until the main current is interrupted, so that a so-called manual reset function is obtained.

A drawback of this structure is that an additional component (requiring additional space) and contact making means has to be added, whilst special care should be bestowed on stability, for instance in the event of vibrations. It is a further drawback that in the automatic reset function, that is without an additional heat source connected in parallel, the switch-back times highly depend upon the ambient temperature, and the range of switch-back times is restricted i.e. by the difference between the switch-back temperature and the ambient temperature.

BRIEF SUMMARY OF THE INVENTION

While maintaining the advantages with respect to the known thermostat mentioned in the above indicated patent, the present invention tends to abolish the above indicated drawbacks and for that purpose it is characterized in that at least one of the pins is made of PTC material (material displaying a positive temperature coefficient of resistivity which is preferably adapted to display a sharp increase in resistivity at a Curie temperature which is cracteristic of the material), from which pins, when energized, electrically generated heat can be transferred by convection and radiation to the temperature sensitive switching element of the thermostat.

Because of the application of said feature the possibilities of use are enlarged by a broader range of switch-back times and reset functions, a simpler mounting without additional components is possible, and minimal room is necessary, said thermostat being reliable in a fabrication-technical respect and the time at which it switches back on again can be accurately influenced.

One, or both, pins can be made of a PTC material with a predetermined Curie temperature with which a simple, solid structure is obtained. Heat generated in this or these PTC pins is transferred by radiation, conduction and convection to the switching member of the thermostat. Because of the close construction of the device the Curie temperature of the PTC pin, when energized, determines mainly the temperature of the switching member and provides self-regulation of the heating provided by the pin. At lower ambient temperatures it creates an artificial direct ambient temperature. When the Curie temperature of the PTC pin is chosen in such a way that this artifical direct ambient temperature lies between the switch-off and switch-on temperature of the thermostat, the latter cannot switch back on again when the ambient temperature falls. Only externally swtiching-off the current can switch the thermostat on again, a so-called manual reset function. When the Curie temperature is chosen in such a way that this artificial direct ambient temperature in the application at decreased ambient temperatures in the situation where the thermal balance is below and close to the switch-on temperature, a very long time for switching-on again is provided. This switching-on takes place automatically and the time of switching-on again depends less upon the ambient temperature. The closer the Curie temperature is to the switch-on temperature, the longer the cooling time of the thermostat will be.

If one of said pins is made of PTC material, security is given in case, upon short circuiting of the pin, the latter would burn. The other pin, made of an insulating material, maintains the function of the thermostat and the mechanical structure of the whole.

DESCRIPTION OF THE DRAWINGS

The invention will now be more fully described by referenced to drawing in which.

DESCRIPTION OF THE PREFERRED EMBODIMENTS

Figure 1:
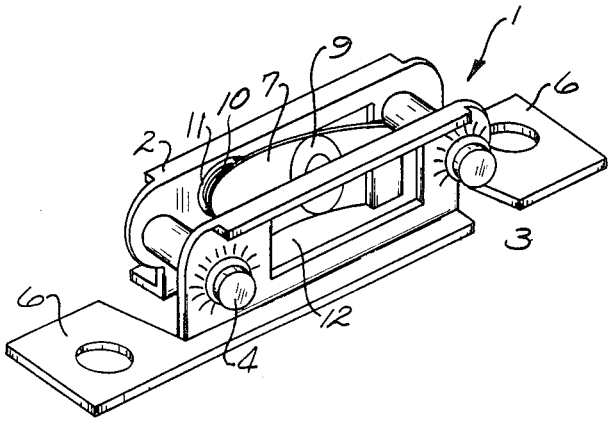
FIG. 1 shows an embodiment of a thermostat according to the invention in perspective.
Figure 2:
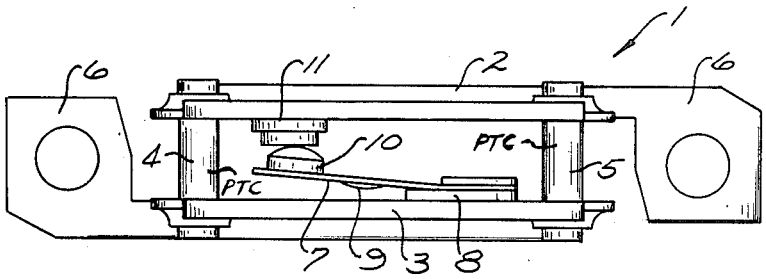
FIG. 2 shows an upper plan view of the thermostat of FIG. 1.

The base unit 1 comprises two mutually parallel, sheet-like preferably metal contact carriers 2 and 3 which, with a tight fit, are fastened on two parallel pins 4 and 5, one pin or both pins thereof being made of a preferably ceramic PTC material.

The pins extend through two deep-drawn holes in the contact carriers. The contact carriers are slidable on the pins to and fro relative to one another and are held mutually parallel by the pins during the composition and adjustment of the thermostat. Each contact carrier comprises connecting terminals 6, 6 which are provided on opposite ends of the base unit and are aligned relative to one another and extend in longitudinal direction of the base unit.

On the inner side of one of the contact carriers 2, 3 a switch element 7 is fastened at 8 on the relevant contact carrier by e.g. welding. The switch element consists of a bimetal and preferably comprises a setting or formed portion 9 which enables independent switching with a snap action at a determined switch-on temperature and switches back at a lower temperature.

If the direct ambient temperture remains above the switch-back temperature no switching-back takes place, unless resetting is performed mechanically or the direct ambient temperature is reduced. The switch-over temperatures are determined by the configuration of the setting and the manner of mounting of the bimetal in known manner.

The setting or formed portion 9 of the bimetal is circular in the shown embodiment, however, it may have another shape too.

The switch element comprises on its movable end a contact 10 adapted to engage a fixed contact 11 fastened on the inner side of the other contact carrier. The contact carriers may have any configuration. For instance they can have an aperture 12 as illustrated in FIG. 1 for laterally exposing almost the entire switch element 7. Furthermore each contact carrier can be made of a resistance material by which the current sensibility of the thermostat increased. The contact carriers can be made of the same material or of two different materials. A contact can consist of three layers, for instance of Ni, Cu, Ag (Cdo). It is also possible that the switch element has not been provided with a setting. The connection terminals can also have various configurations and positions, and a heat well can be used as well as an external or an internal heating means.

In that arrangement, the terminals 6, 6 are adapted to be connected in an electrical circuit so that when the contacts 10, 11 are engaged the circuit is closed but so that when the bimetal 7 moves in response to a selected temperature change for separating the contacts 10, 11, the circuit is opened. As will be understood, the temperature at which the circuit opens is determined primarily by the temperature response characteristics or actuating temperature of the bimetal but the carriers 2 and 3 are selectively movable relative to each other on the pins 4, 5 as described in the noted patent for calibrating or adjusting the actuating or circuit-opening temperature of the thermostat. As will also be understood, the bimetal is also adapted to reengage the contacts 10, 11 for reclosing the circuit when the temperature of the bimetal falls to a reset temperature relatively lower than the noted actuating temperature.

In accordance with this invention, the PTC pins 4, 5 are formed of a ceramic material or the like of positive temperature coefficient of resistivity which has a selected first, room temperature resistivity which s relatively low but which is preferably sufficient for the pins to display an electrical resistance greater than that displayed by the bimetal 7 and its associated contacts. However the pin material is adapted to display a sharp increase in resistivity at a temperature which is preferably selected to be between the actuating the reset temperatures of the bimetal such that when the pins are self-heated by directing electrical current thrrough the pins, the pins serve as a self-regulating electrical resistance heater and stabilize at a temperature which is sufficient to maintain the bimetal 7 at a temperature between its actuating and reset temperatures during variations in the general ambient temperature.

In that arrangement, when the terminals 6, 6 are connected in a circuit, where the thermostat is disposed to sense normal temperature in a temperature zone to be monitored with the thermostat, the contacts 10, 11 are in their normally engaged position for closing the circuit and no significant current flows between the carriers 2, 3 via the pins 4, 5. However, if the bimetal 7 is heated to its actuating or circuit-opening temperature in response to a predetermined increase in the temperature being monitored with the thermostat so that the bimetal moves to open the circuit, a significant current occurs briefly in the pins for rapidly heating the pin material to its high resistivity temperature to effectively complete opening of the circuit between the carriers 2, 3. However a small current continues to flow in the high resistivity pins to generate heat at the stabilizing temperature of the pins sufficient for maintaining the bimetal 7 above its reset temperature even though the temperature being monitored by the thermostat should return to its original or normal level. The thermostat is thus adapted to remain open until it is manually reset, by disconnecting it from the circuit for example, to permit the pins 3, 4 to cool to their original room temperature resistivity.

It should be understood that although particular embodiments of the invention are described by way of illustrating the invention, this invention includes all modifications and equivalents falling within the scope of the appended claims.

What is claimed is:

1. A thermostat comprising a bimetal switch element reacting upon changes in temperature, which on one of its ends is fastened on a frame and on another end is provided with a movable electric contact adapted to engage a fixed contact provided on the frame, said frame comprising two mutually parallel sheet-like contact carries forming a base unit, respectively mounting the bimetal switch element and the fixed contact, through which two parallel pins are extending for connection of both contact carriers and on which pins the contact carriers, with a tight fit, are slidable to and fro relative to one another to be held in permanent mutually parallel relation during such sliding, characterized in that at least one of the pins is made of PTC material, from which pins, when energized, electrically generated heat can be transferred by conduction, convection and radiation to the bimetal switch element of the thermostat.

2. A thermostat according to claim 1, further characterized in that the PTC material has a Curie temperature chosen so that the pins when electrically energized self-regulates to stabilize at a selected temperature such that the resulting temperature at the bimetal switch element stays between the actuating and the reset temperatures of the bimetal switch element when ambient temperature decreases.

3. A thermostat according to claim 1, further characterized in that the PTC material has a Curie temperature chosen so that the resulting temperature at the bimetal switch element is relatively closer to the reset temperature than to the actuating temperature of the bimetal switch element.

* * * * *